US011672284B1

(12) United States Patent
Furis

(10) Patent No.: US 11,672,284 B1
(45) Date of Patent: Jun. 13, 2023

(54) BODY POSITIONING APPARATUS

(71) Applicant: Annese Furis, St. Augustine, FL (US)

(72) Inventor: Annese Furis, St. Augustine, FL (US)

( * ) Notice: Subject to any disclaimer, the term of this patent is extended or adjusted under 35 U.S.C. 154(b) by 0 days.

(21) Appl. No.: 17/947,013

(22) Filed: Sep. 16, 2022

(51) Int. Cl.
*A41C 3/12* (2006.01)

(52) U.S. Cl.
CPC ..... *A41C 3/12* (2013.01)

(58) Field of Classification Search
CPC ..... A41C 3/12; A41C 3/00
USPC ..... 450/82, 85
See application file for complete search history.

(56) References Cited

U.S. PATENT DOCUMENTS 1,167,741 A * 1/1916 Clarke ..... A41C 3/10 602/61
2,130,534 A * 9/1938 Bowen ..... A41C 3/00 450/86
2,131,457 A 9/1938 Sa et al.
2,388,757 A * 11/1945 Miller ..... A41C 3/00 450/84
2,406,699 A 8/1946 Florence
2,413,060 A * 12/1946 Werners ..... A41C 3/00 450/64
2,475,893 A 7/1949 Kathleen
2,583,716 A * 1/1952 Alberto ..... A41C 3/00 450/41
D167,394 S * 8/1952 Dubner ..... D2/706
2,616,083 A * 11/1952 Sade ..... A41C 3/00 450/53
2,679,646 A * 6/1954 Cousins ..... A41C 3/0007 450/83
2,688,749 A * 9/1954 Cocks ..... A41F 1/006 450/83
2,723,395 A 11/1955 Paula
2,979,057 A 4/1961 Miller
D203,500 S * 1/1966 Nobbs ..... D2/709
3,710,800 A 1/1973 Carey
6,102,772 A * 8/2000 Fernandez ..... A41C 3/00 450/1
6,113,460 A * 9/2000 McKeown ..... A41C 3/08 450/11

(Continued)

OTHER PUBLICATIONS https://www.instagram.com/zbzzsupportforsleep/.
ZBZZ Supportive Sleep Bra; https://www.coolbeautysleep.com/shop/p/zbzz-supportive-sleep-bra.

*Primary Examiner* — Gloria M Hale
(74) *Attorney, Agent, or Firm* — Camille A. Wilson; Wilson Dutra, PLLC

(57) ABSTRACT

The present disclosure provides for a body positioning apparatus. The body positioning apparatus may comprise a first strap. The body positioning apparatus may comprise a second strap. The body positioning apparatus may comprise at least one fastening mechanism. The body positioning apparatus may comprise at least one connecting element. The body positioning to apparatus may comprise at least one alignment portion. The body positioning apparatus may comprise a unified piece that comprises the first strap, the second strap, and the at least one alignment portion. The body positioning apparatus may comprise at least one intermediate material. The body positioning apparatus may comprise at least one internal material. When the body positioning apparatus comprises at least one alignment portion, the at least one alignment portion may comprise less elasticity than the first strap or the second strap, or both.

17 Claims, 7 Drawing Sheets

(56) References Cited

U.S. PATENT DOCUMENTS

| | | | | |
|---|---|---|---|---|
| 6,213,842 | B1 | 4/2001 | Degirmenci | |
| 6,319,092 | B1 | 11/2001 | Leyhe | |
| 6,406,353 | B1 * | 6/2002 | Harper | A41C 3/12 450/1 |
| 7,001,240 | B1 * | 2/2006 | Huffman-Jimenez | A41F 1/006 450/60 |
| 7,056,187 | B2 | 6/2006 | Cassity | |
| D584,879 | S * | 1/2009 | Venus | D2/706 |
| 8,007,343 | B1 * | 8/2011 | Komsky | A41B 9/12 2/268 |
| 8,047,892 | B1 * | 11/2011 | Dempsey | A41C 3/005 450/57 |
| 9,700,080 | B1 * | 7/2017 | Hansraj | A41C 3/0021 |
| 11,197,506 | B2 * | 12/2021 | Arshava | A41C 3/0064 |
| 2003/0104759 | A1 | 6/2003 | Kawami | |
| 2016/0000154 | A1 | 1/2016 | Furis | |

* cited by examiner

200

600

BODY POSITIONING APPARATUS

BACKGROUND

Throughout history, there has been a conflict in apparel between comfort, functionality, and presentability. There are basic functional purposes for many articles within the clothing industry. For example, gloves may protect hands during hard labor, provide grip for slippery or difficult to grab surfaces, or provide warmth in cold temperatures. Oftentimes, items of clothing with functional purposes try to make the wearing experience pleasant by adding comfort, such as by improving the material of the clothing or improving the design of the clothing item.

One example of trying to combine comfort with function is the women's brassiere, or "bra." Functionally, the bra must perform according to certain metrics such as support and fit while still remaining comfortable and easy to wear for prolonged periods of time. However, conventional methods of support, such as internal wires, often improve the support of the bra at the expense of decreased comfort. Additionally, the support is often provided in a limited number of directions.

For example, the bra is meant to support vertically, but provides much less support and control laterally. This becomes of special concern in situations, such as sleeping, where the vertical support features may be unnecessary, or even unwanted. This can lead not only to discomfort from the lack of lateral support and a poor or constrained fit, but it can also lead to overheating and other secondary discomforts that result from a lack of proper breast alignment when the wearer may be in non-vertical positions, such as while sleeping on a right or left side of the body or while sleeping in a supine position.

SUMMARY OF THE DISCLOSURE

What is needed is a body positioning apparatus that provides sufficient lateral support in a plurality of physical positions (e.g., standing, sitting, or laying down) while providing a fit that keeps the wearer cool and comfortable.

The present disclosure provides for a body positioning apparatus. In some embodiments, the body positioning apparatus may comprise a first strap. In some implementations, the body positioning apparatus may comprise a second strap. In some aspects, the body positioning apparatus may comprise at least one fastening mechanism.

In some embodiments, the body positioning apparatus of the present disclosure may comprise at least one connecting element. In some implementations, the body positioning apparatus may comprise at least one alignment portion. In some aspects, the body positioning apparatus may comprise a unified continuous piece that comprises the first strap, the second strap, and the at least one alignment portion.

In some embodiments, the body positioning apparatus of the present disclosure may comprise at least one intermediate material. In some aspects, the body positioning apparatus may comprise at least one internal material. When the body positioning apparatus comprises at least one alignment portion, the at least one alignment portion may comprise less elasticity or stretchiness than the first strap or the second strap, or both. In some embodiments, the at least one connecting element may be removable. In some implementations, the at least one connecting element may comprise at least one fastening mechanism.

BRIEF DESCRIPTION OF THE DRAWINGS

The accompanying drawings that are incorporated in and constitute a part of this specification illustrate several embodiments of the disclosure and, together with the description, serve to explain the principles of the disclosure.

DETAILED DESCRIPTION

In the following sections, detailed descriptions of examples and methods of the disclosure will be given. The descriptions of both preferred and alternative examples, though thorough, are exemplary only, and it is understood to those skilled in the art that variations, modifications, and alterations may be apparent. It is therefore to be understood that the examples do not limit the broadness of the aspects of the underlying disclosure as defined by the claims.

Glossary

Elasticity: As used herein, refers to the ability of an object or material to resume its normal shape after being stretched or compressed. That is, elasticity refers to the "stretchiness" of a material or object, such that materials or objects that have high elasticity are more prone to stretching than materials or objects with low elasticity.

Figure 1:
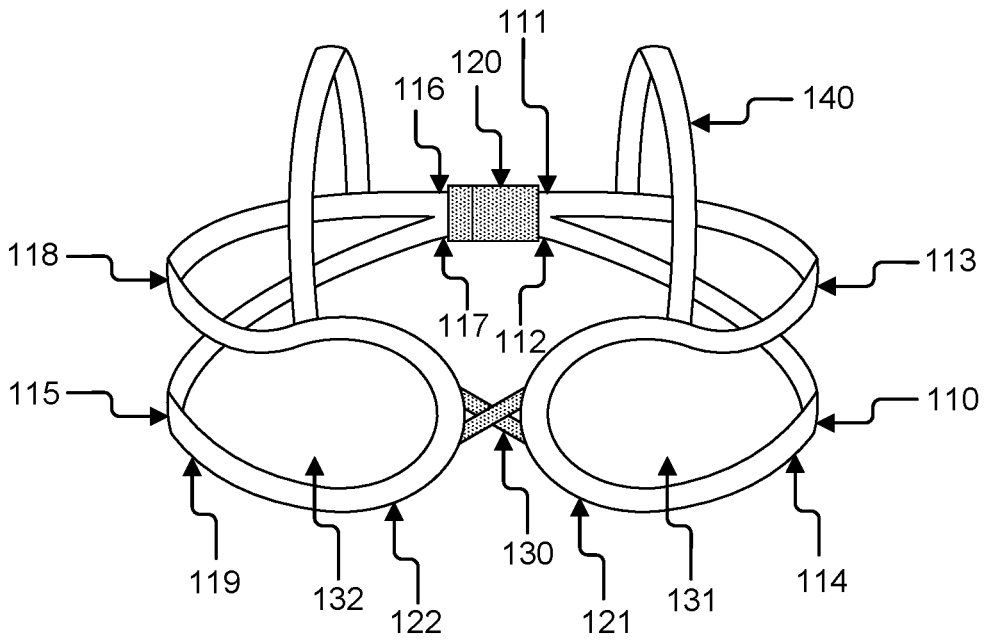
FIG. 1 illustrates an exemplary body positioning apparatus, according to some embodiments of the present disclosure.

Referring now to FIG. 1, an exemplary body positioning apparatus 100 is illustrated. In some embodiments, the body positioning apparatus 100 may comprise a first strap 110 comprising two terminating distal ends 111, 112. In some implementations, the body positioning apparatus 100 may comprise a second strap 115 comprising two terminating distal ends 116, 117. In some aspects, at least one of the distal ends 111, 112 of the first strap 110 may be joined to at least one of the the distal ends 116, 117 of the second strap 115 by at least one fastening mechanism 120.

In some embodiments, the distal ends 111, 112 of the first strap 110 may converge and the distal ends 116, 117 of the second strap 115 may converge such that the first strap 110 and the second strap 115 are each configured as continuous loops, with a substantially open inner area 131, 132 existing within each of the first strap 110 and the second strap 115. In some aspects, the distal ends 111, 112 of the first strap 110 may be securely or removably attached together and the distal ends 116, 117 of the second strap 115 may be securely or removably attached together, wherein attachment of the respective distal ends 111, 112, 116, 117 may be achieved, for example and not limitation, via stitching, adhesion, at least one hook and loop fastener, or at least one magnet, as well as via any similar means, including any combination thereof.

In some implementations, the distal ends 111, 112 of the first strap 110 and the distal ends 116, 117 of the second strap 115 may be connected at a back portion of a user when the body positioning apparatus 100 is worn by the user. In this configuration, the substantially open inner area 131, 132 of each of the first strap 110 and the second strap 115 may extend to the front of the user so as to removably receive at least a portion of a human breast therein. In some aspects, the first strap 110 may be positioned near the base of a first human breast and the second strap 115 may be positioned near the base of a second human breast when the body positioning apparatus 100 is worn by a user. In some non-limiting exemplary embodiments, the width of the first strap 110 and the width of the second strap may be approximately 1.5 to 2 inches.

In some aspects, one or both of the distal ends 111, 112 of the first strap 110 may be removably attachable to one or both of the distal ends 116, 117 of the second strap 115 by at least one fastening mechanism 120. By way of example and not limitation, the at least one fastening mechanism 120 may comprise at least one of: a hook, a clasp, a clip, a buckle, a magnet, a hook and loop fastener, and a snap, or any similar fastening mechanism 120, as well as any combination thereof. In some embodiments, the fastening mechanism 120 may comprise an adjustment means that allows the size or fit of the body positioning apparatus 100 to be altered. By way of example and not limitation, the fastening mechanism 120 may comprise an adjustable buckle that allows a length of an exposed or usable portion of the first strap 110 and/or the second strap 115 to be altered, thereby adjusting the size and fit of the body positioning apparatus 100.

In some implementations, a first loop formed by the first strap 110 may comprise an upper portion 113 and a lower portion 114, wherein the upper portion 113 comprises a portion of the first strap 110 that may be above the lower portion 114 of the first strap 110 when the body positioning apparatus 100 may be worn by a user, as well as a transition portion 121 that comprises a portion of the first strap 110 that curves and transitions between the upper portion 113 and the lower portion 114.

In some embodiments, a second loop formed by the second strap 115 may comprise an upper portion 118 and a lower portion 119, wherein the upper portion 118 of the second strap 115 may be above the lower portion 119 of the second strap 115 when the body positioning apparatus 100 may be worn by a user, as well as a transition portion 122 that comprises a portion of the second strap 115 that curves and transitions between the upper portion 118 and the lower portion 119.

In some aspects, the transition portion 121 of the first strap 110 may be proximate or adjacent to the transition portion 122 of the second strap 115 when the body positioning apparatus 100 is worn by a user. In some implementations, the transition portions 121, 122 of the first strap 110 and the second strap 115 may be configured between a right breast and a left breast of a user when the body positioning apparatus 100 is worn by the user. In some embodiments, the transition portion 121 of the first strap 110 may be securely or removably attached to the transition portion 122 of the second strap 115 by at least one connecting element 130.

By way of example and not limitation, the at least one connecting element 130 may comprise at least one of: a strip, strap, or other narrow elongated piece of one or more materials or fabrics or a segment or section of one or more materials or fabrics, wherein at least one of the materials or fabrics may comprise an at least partial elasticity, such as elastane, rubber, neoprene, and/or nylon, as non-limiting examples. In some aspects, two or more connecting elements 130 may be configured in a horizontal or diagonal orientation. In some implementations, at least a portion of two adjacent connecting elements may at least partially overlap, such as in a crisscross configuration. In some aspects, adjacent connecting elements 130 may remain physically separate from each other and all other connecting elements 130. In some non-limiting exemplary embodiments, the width of the at least one connecting element may be approximately one-half inch or less. In some non-limiting aspects, the width of the at least one connecting element may be approximately 0.375 inch.

In some embodiments, the body positioning apparatus 100 may comprise two horizontally-oriented substantially parallel connecting elements 130 that comprise no overlapping portions and remain substantially physically separate from each other. In some implementations, one of the two connecting elements 130 may be positioned at or near a horizontal midline of a user's breasts, with the other connecting element 130 positioned slightly higher. In some aspects, this configuration of the connecting elements 130 may facilitate the natural movement of the user's breasts while still allowing the first strap 110 and the second strap 115 to maintain the breasts in a substantially separate lateral alignment when the body positioning apparatus apparatus 100 is worn by the user. In some implementations, comprising two physically separate horizontal connecting elements 130 may also facilitate airflow to the region between the user's breasts, allowing for a cooler and more comfortable wearing experience.

In some implementations, the body positioning apparatus 100 may comprise one or more alignment portions 140. In some embodiments, each alignment portion 140 may comprise two distal ends that may be securely or removably attached to the first strap 110 and/or the second strap 115, such as, for example and not limitation, via stitching or at least one hook. In some aspects, the distal ends of each alignment portion 140 may be securely or removably attached to an upper portion 113 of the first strap 110 and/or an upper portion 118 of the second strap 115. In some implementations, each alignment portion 140 may be configured to at least partially extend around at least one of: at least a portion of a shoulder of a user, at least a portion of an upper back of a user, and at least a portion of a neck of a user when the body positioning apparatus 100 is worn by the user.

In some implementations, the body positioning apparatus 100 may comprise two alignment portions 140, wherein a first alignment portion 140 may extend from the upper portion 113 of the first strap 110 in the front of a user, over a first shoulder the user, and to the upper portion 113 of the first strap 110 in the back of the user when the user may wear the body positioning apparatus 100. Similarly, a second alignment portion 140 may extend from the upper portion 118 of the second strap 115 in the front of the user, over a second shoulder of the user, and to the upper portion 118 of the second strap 115 in the back of the user when the user may wear the body positioning apparatus 100.

In some embodiments, the first strap 110 and the second strap 115 may each comprise at least one at least partially elastic material, such as, by way of example and not limitation, elastane, rubber, neoprene, nylon, or any similar material, as well as any combination thereof, that gives the first strap 110 and the second strap 115 an elasticity. In some implementations, the elasticity of the first strap 110 and the elasticity of the second strap 115 may be sufficient to provide an outward lateral force directed away from the center of a user's body, wherein the outward lateral force may be applied to each breast of the user. In some aspects, these outward lateral forces may be applied such that the right breast of the user may be substantially prevented from making physical contact with the left breast of the user, particularly for long periods of time, when the body positioning apparatus is worn by the user, regardless of what physical position the user may be in.

For example, if a user prefers to sleep on a right of left side of the user's body at night, the user's right breast and left breast may be pressed together in an uncomfortable manner due to the forces of gravity and the support provided by the user's bed. By wearing the body positioning apparatus 100, the user's breasts may be prevented from being pressed together all night, minimizing uncomfortable heat buildup, perspiration, and friction.

In some aspects, the elasticity of the first strap 110 and the elasticity of the second strap 115 of the body positioning apparatus 100 may be configured to provide lateral forces that maintain a user's breasts in a natural, resting, laterally aligned orientation, such as an orientation that may be achieved when the user is standing, when the body positioning apparatus 100 is worn by the user, regardless of what physical position the user may be in.

In some implementations, each connecting element 130 that may be used with the body positioning apparatus 100 may comprise at least one at least partially elastic material, such as, by way of example and not limitation, elastane, rubber, neoprene, nylon, or any similar material, as well as any combination thereof, that gives each connecting element 130 an elasticity.

In some aspects, the elasticity of each connecting element 130 may be greater than the elasticity of the first strap 110 and the second strap 115. This may allow the connecting element(s) 130 to provide stability to the body positioning apparatus 100 by helping retain the structural configuration of the body positioning apparatus 100 without negatively interfering with the ability of the first strap 110 and the second strap 115 to provide outward lateral separating forces to the breasts of a user wearing the body positioning apparatus 100. In some non-limiting exemplary embodiments, the unstretched length of each connecting element 130 may be configured so that one or more regions of each connecting element 130 does not make prolonged or, in some aspects, even temporary physical contact with the user's body when the body positioning apparatus 100 is worn by the user, thereby minimizing the potential for the connecting elements 130 to rub against and generate friction that may irritate the user's skin. In some implementations, the unstretched length of each connecting element 130 may be configured so that no part of each connecting element 130 physically contacts the user's body while wearing the body positioning apparatus 100.

In some implementations, at least one fastening mechanism 120 may securely or removably attach at least one of the distal ends 111, 112 of the first strap 110 to at least one of the distal ends 116, 117 of the second strap 115. In some aspects, the fastening mechanism 120 may secure the distal end(s) 111, 112 of the first strap 110 to the distal end(s) 116, 117 of the second strap 115 via a mated connection, in which the mated connection comprises two mated ends of the fastening mechanism 120 that connect via a parallel surface, such as magnets, at least one hook and loop fastener, at least one hook, at least one clip, or at least one clasp, as non-limiting examples. In some embodiments, the mated ends may connect at the mated connection in an adjacent configuration. In some implementations, the adjacent configuration of the mated ends may not overlap, but rather may attach directly.

In some aspects, the body positioning apparatus 100 may comprise one or more alignment portions 140. In some embodiments, the alignment portion(s) 140 may comprise at least one at least partially elastic material, such as, by way of example and not limitation, elastane, rubber, neoprene, nylon, or any similar material, as well as any combination thereof, that gives the alignment portion(s) an elasticity.

In some implementations, the alignment portion(s) 140 may comprise an elasticity that is less than the elasticity of the first strap 110 and the second strap 115, as well as any connecting elements 130 that may be included with the body positioning apparatus 100. By comprising an elasticity that is less than the elasticity of the first strap 110 and the second strap 115, the alignment portion(s) 140 may maintain the upper portions 113, 118 of the first strap 110 and the second strap 115 in a relatively stable and consistent position above the left and right breast of a user without providing substantial vertical lifting or supporting forces to the lower portions 114, 119 of the first strap 110 and the second strap 115.

In this configuration, the alignment portion(s) 140 may interact with the shoulder(s) or neck of a user without substantially supporting the weight of the user's breasts, thereby reducing the pressure applied to the shoulder(s) or neck of the user by the alignment portion(s) 140 when the body positioning apparatus 100 is worn and making the body positioning apparatus 100 more comfortable to wear.

In some aspects, the alignment portion(s) 140 may assist with maintaining alignment of the body positioning apparatus 100. In some embodiments, this alignment may comprise maintaining alignment of one or more portions of the body positioning apparatus 100 with other portions of the body positioning apparatus 100. In some implementations, the alignment portion(s) 140 may maintain alignment between one or more portions the body positioning apparatus 100 and one or more parts of the body of a user wearing the body positioning apparatus 100.

In some aspects, the alignment portion(s) 140 may comprise sufficient rigidity such that one or more regions of the alignment portion(s) 140 may generally remain substantially void of contact with a user wearing the body positioning apparatus 100. In some embodiments, these regions may come into contact with the user only temporarily. In some implementations, these regions may come into contact with the user only when the user undergoes dramatic or substantial ranges of movement.

In some aspects, the brief contact of one or more regions of the alignment portion(s) 140 with the user may provide an aligning force that may facilitate the proper alignment of the body positioning apparatus 100 when the body positioning apparatus 100 may be worn by the user. In some embodiments, the aligning force may comprise a minimal amount force for alignment of the body positioning apparatus 100 without providing any substantial lifting or supportive forces to the user's breasts or other parts of the user's body.

For example, a user may decide to wear the body positioning apparatus 100 while sleeping. While laying still, one or more regions of the alignment portion(s) 140 may make little or no contact with the user's body. As the user may change positions during the night, the alignment portion(s)

140 may apply just enough retention force to keep the body positioning apparatus 100 in place without providing substantial physical supportive forces to the user's breasts, or any other portion(s) of the user's body.

In some implementations, each connecting element 130 of the body positioning apparatus 100 may be detachable or removable. In some aspects, each connecting element 130 may comprise an unstretched length configured to maintain a minimum distance between the transition portion 121 of the first strap 110 and the transition portion 122 of the second strap 115. In some embodiments, one or more of the connecting elements 130 may comprise a minimum unstretched length that may adjustable to modify the minimum maintained distance between the transition portion 121 of the first strap 110 and the transition portion 122 of the second strap 115.

Figure 2A:
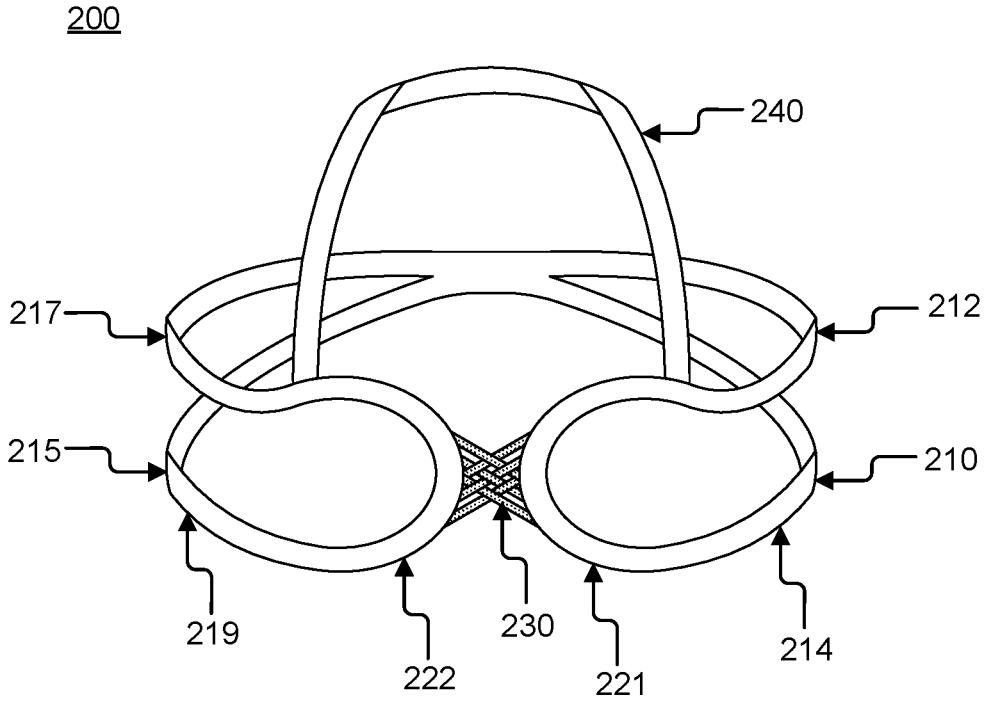
FIG. 2A illustrates an exemplary body positioning apparatus comprising an alignment portion, according to some embodiments of the present disclosure.
Figure 2B:
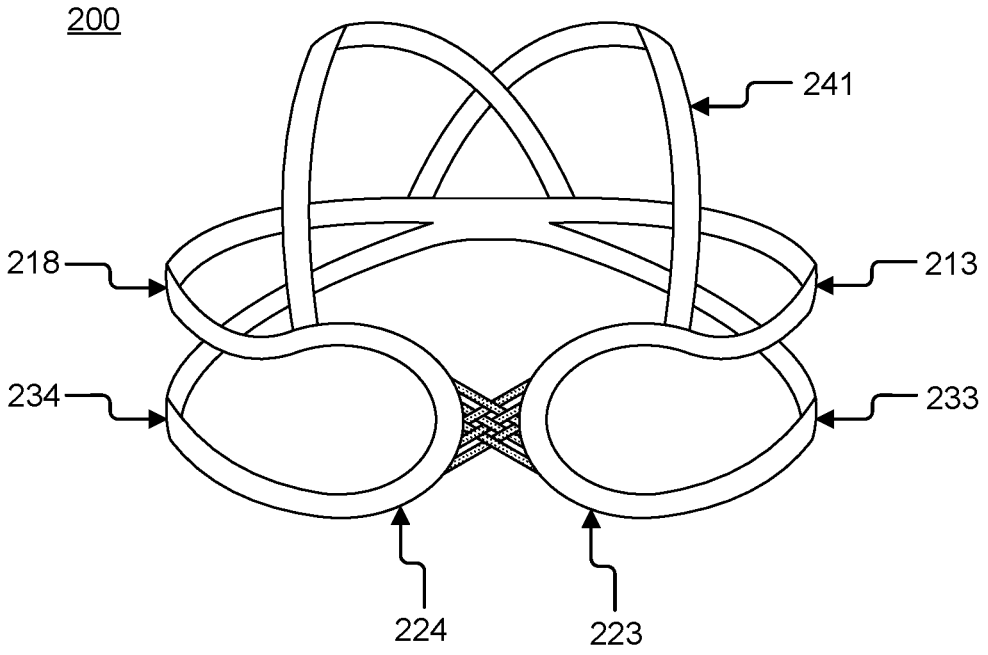
FIG. 2B illustrates an exemplary body positioning apparatus comprising an alignment portion, according to some embodiments of the present disclosure.
Figure 2C:
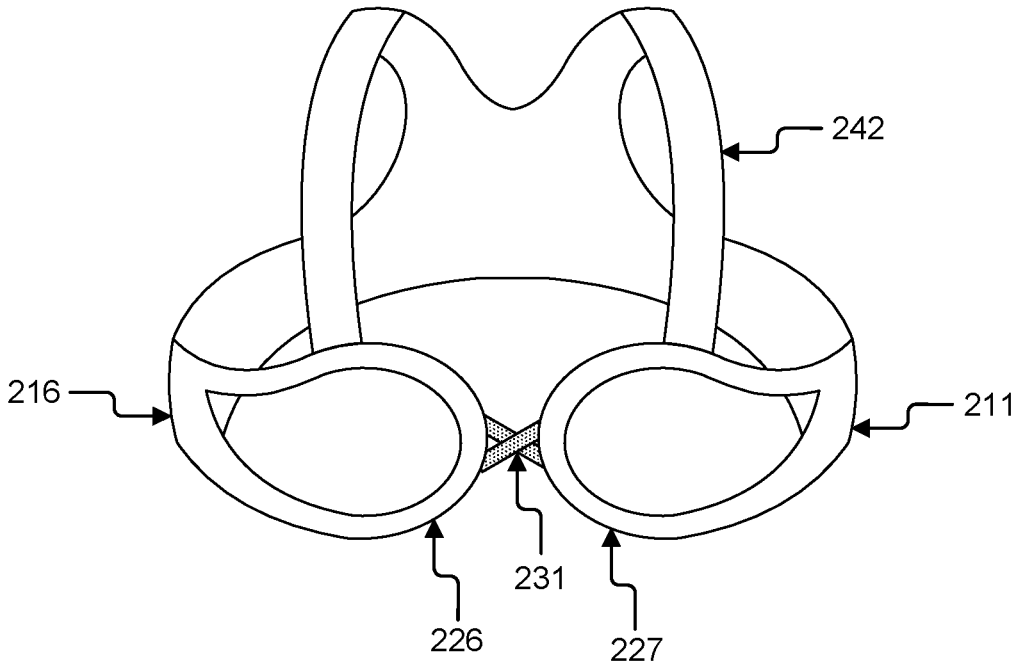
FIG. 2C illustrates an exemplary body positioning apparatus comprising an alignment portion, according to some embodiments of the present disclosure.

Referring now to FIGS. 2A-C, an exemplary body positioning apparatus 200 comprising an alignment portion 240, 241, 242 is illustrated. In some embodiments, the body positioning apparatus 200 may comprise a first strap 210, 211. In some implementations, the body positioning apparatus 200 may comprise a second strap 215, 216.

In some embodiments, the curved transition portions 221, 222, 223, 224, 226, 227 of both the first strap 210, 211 and the second strap 215, 216 may be securely or removably connected by at least one connecting element 230, 231. In some implementations, the body positioning apparatus 200 may comprise one or more alignment portions 240, 241, 242.

In some aspects, the body positioning apparatus 200 may comprise a first strap 210 connected to a second strap 215 by at least one connecting element 230.

In some embodiments, the body positioning apparatus 200 may comprise a first strap 211, a second strap 216, at least one connecting element 231, and at least one alignment portion 242 that may form a continuous unit, wherein the listed components may comprise regions of the continuous unit. In some implementations, the continuous connected configuration of the body positioning apparatus 200 may improve comfort for a user by comprising a single, continuous piece of material or combination of materials, which, in some non-limiting exemplary embodiments, may comprise at least one at least partially elastic material, such as elastane, rubber, neoprene, or nylon, as non-limiting examples. In some aspects, the continuous connected body positioning apparatus 200 may be more accommodating to a user by, for example and not limitation, being easy to put on and take off.

In some aspects, the body positioning apparatus 200 may comprise one or more alignment portions 240, 241, 242. In some embodiments, the alignment portion(s) 240, 241, 242 may at least partially comprise at least one elastic material, such as, by way of example and not limitation, elastane, rubber, neoprene, nylon, or any similar material, as well as any combination thereof.

In some implementations, the elasticity of the alignment portion(s) 240, 241, 242 may be less than the elasticity of the first strap 210 and the second strap 215, thereby allowing the alignment portion(s) 240, 241, 242 to maintain the upper portions 212, 213, 217, 218 of the first strap 210 and the second strap 215 in a relatively stable and consistent position above the left and right breast of a user without providing substantial vertical lifting or supporting forces to the lower portions 214, 219, 233, 234 of the first strap 210 and the second strap 215.

In some aspects, the alignment portion(s) 240, 241, 242 may assist with maintaining alignment of the body positioning apparatus 200. In some embodiments, this alignment may comprise maintaining alignment of one or more portions of the body positioning apparatus 200 with other portions of the body positioning apparatus 200. In some implementations, the alignment portion(s) 240, 241, 242 may maintain alignment between one or more portions of the body positioning apparatus 200 and one or more parts of the body of a user wearing the body positioning apparatus 200.

In some aspects, the alignment portion(s) 240, 241, 242 may comprise sufficient rigidity such that one or more regions of the alignment portion(s) 240, 241, 242 may generally remain substantially void of contact with a user wearing the body positioning apparatus 200. In some embodiments, these regions may come into contact with the user only temporarily. In some implementations, these regions may come into contact with the user only when the user undergoes dramatic or substantial ranges of movement.

In some aspects, the brief contact of one or more regions if the alignment portion(s) 240, 241, 242 with the user may provide an aligning force that may facilitate the proper alignment of the body positioning apparatus 200 when the body positioning apparatus 200 may be worn by the user. In some embodiments, the aligning force may comprise a minimal amount of force for alignment of the body positioning apparatus 200, without providing any substantial lifting or supportive forces to the user's breasts or other parts of the user's body.

In some implementations, each connecting element 230 of the body positioning apparatus 200 may be detachable. In some aspects, each connecting element 230 may comprise an unstretched length configured to maintain a minimum distance between the curved transition portion 221, 223, 227 of the first strap 210 and the curved transition portion 222, 224, 226 of the second strap 215. In some embodiments, one or more of the connecting elements 230 may comprise a minimum unstretched length that may be adjustable to modify the minimum maintained distance between the transition portion 221, 223, 227 of the first strap 210 and the transition portion 222, 224, 226 of the second strap 215.

Figure 3:
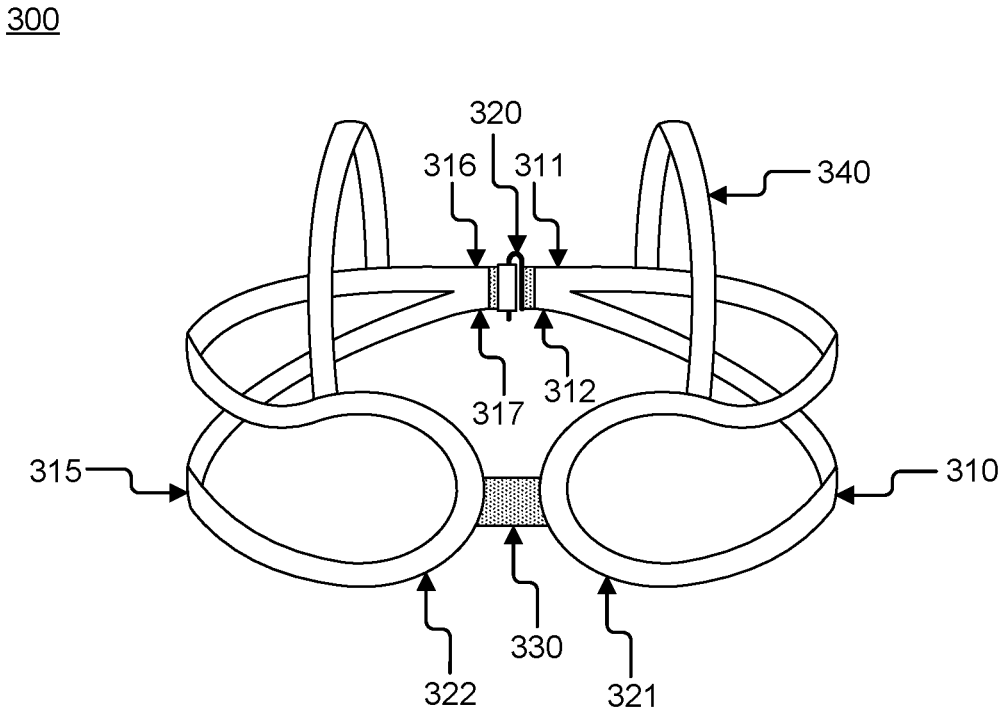
FIG. 3 illustrates an exemplary body positioning apparatus comprising an alignment portion, according to some embodiments of the present disclosure.

Referring now to FIG. 3, an exemplary body positioning apparatus 300 comprising an alignment portion 340 is illustrated. In some embodiments, the body positioning apparatus 300 may comprise a first strap 310. In some implementations, the body positioning apparatus 300 may comprise a second strap 315. In some aspects, one or both of the terminating distal ends 311, 312 of the first strap 310 may be securely or removably joined to one or both of the terminating distal ends 316, 317 of the second strap 315 by at least one fastening mechanism 320.

In some embodiments, the curved transition portions 321, 322 of both the first strap 310 and the second strap 315 may be securely or removably connected by at least one connecting element 330. In some implementations, the body positioning apparatus 300 may comprise one or more alignment portions 340.

In some implementations, one or more of the connecting elements 330 of the body positioning apparatus 300 may be detachable or removably attachable. In some aspects, the connecting element(s) 330 may comprise an unstretched length configured to maintain a minimum distance between the transition portion 321 of the first strap 310 and the transition portion 322 of the second strap 315. In some embodiments, each connecting element 330 may comprise a minimum unstretched length that may be adjustable to modify the minimum maintained distance between the transition portion 321 of the first strap 310 and the transition portion 322 of the second strap 315.

Figure 4:
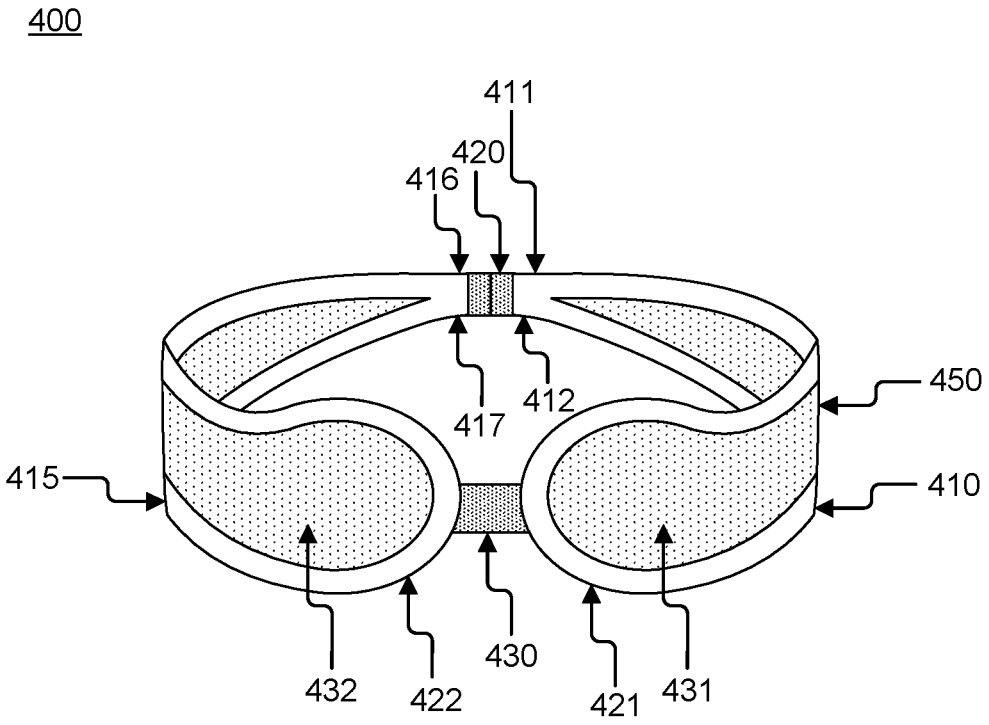
FIG. 4 illustrates an exemplary body positioning apparatus, according to some embodiments of the present disclosure.

Referring now to FIG. 4, an exemplary body positioning apparatus 400 is illustrated. In some embodiments, the body positioning apparatus 400 may comprise a first strap 410. In some implementations, the body positioning apparatus 400 may comprise a second strap 415. In some aspects, one or both of the terminating distal ends 411, 412 of the first strap 410 may be securely or removably joined to one or both of the terminating distal ends 416, 417 of the second strap 415 by at least one fastening mechanism 420.

In some embodiments, the curved transition portions 421, 422 of both the first strap 410 and the second strap 415 may be securely or removably connected by at least one connecting element 430. In some implementations, the first strap 410 or the second strap 415, or both, may comprise at least one intermediate material 450 configured to at least partially cover the substantially open inner area 431, 432 of at least one of: the first strap 410 and the second strap 415.

In some aspects, the intermediate material 450 may comprise a loose connecting fabric within the substantially open inner area 431, 432 of the first strap 410, the second strap 415, or both. In some implementations, the intermediate material 450 may at least partially comprise at least one elastic material, such as elastane, rubber, neoprene, nylon, or any similar material, as well as any combination thereof.

In some aspects, the elasticity of the intermediate material 450 may be greater than the elasticity of the first strap 410 and the second strap 415 so that the intermediate material 450 does not interfere with the ability of the the body positioning apparatus 400 to position a user's breasts in a substantially laterally separated state. In some embodiments, the intermediate material 450 may provide comfort to the user by providing a means to achieve a higher degree of modesty for use in different situations than the traditional nighttime or home use of the body positioning apparatus 400. In some implementations, the intermediate material 450 may be removably attachable, such that an outer perimeter or edge of the intermediate material 450 may removably interface with at least one of: the first strap 410 and the second strap 415, such as via at least one hook and loop fastener, at least one magnet, or any similar attachment means, as non-limiting examples.

For example, a user may use a body positioning apparatus 400 without intermediate material 450 around the house for comfort or while sleeping. When the user goes to the store, the user may use a body positioning apparatus 400 with an intermediate material 450 to maintain the same level of comfort while providing a better fit to wear underneath a casual shirt or dress. In some non-limiting exemplary implementations, the intermediate material 450 may comprise a smooth material, such as silk, to facilitate the comfort and breathability of the body positioning apparatus 400.

In some aspects, the body positioning apparatus 400 may be configured to provide both a vertical supporting force to a user's breast's as well as a lateral alignment force. In some embodiments, using a first strap 410, second strap 415, and connecting element(s) 430 with a decreased elasticity may be more comfortable for situations such as exercise or high physical activity, when a tighter fit may provide more comfort to the user.

Figure 5:
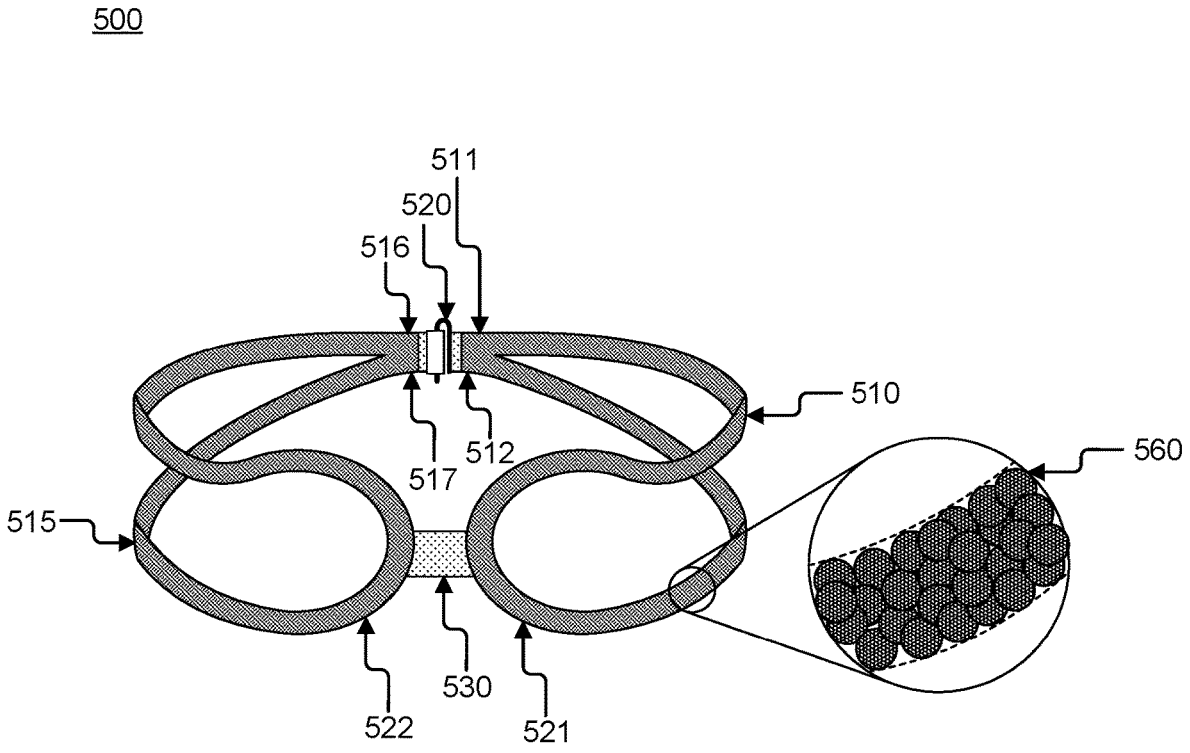
FIG. 5 illustrates an exemplary body positioning apparatus, according to some embodiments of the present disclosure.

Referring now to FIG. 5, an exemplary body positioning apparatus 500 is illustrated. In some embodiments, the body positioning apparatus 500 may comprise a first strap 510. In some implementations, the body positioning apparatus 500 may comprise a second strap 515. In some aspects, one or both of the terminating distal ends 511, 512 of the first strap 510 may be securely or removably joined to one or both of the terminating distal ends 516, 517 of the second strap 515 by at least one fastening mechanism 520.

In some embodiments, the curved transition portions 521, 522 of both the first strap 510 and the second strap 515 may be securely or removably connected by at least one connecting element 530. In some implementations, the first strap 510 or the second strap 515, or both, or any other portion of the body positioning apparatus 500 may comprise at least one internal material 560.

In some implementations, the at least one internal material 560 may comprise one or more physical properties that may provide one or more features to the body positioning apparatus 500. By way of example and not limitation, the internal material 560 may comprise at least one of: an an amount of absorbent material, such as cotton, to remove perspiration and moisture from a user's skin; an amount of insulating material, such as wool or fleece, to help keep a user warm; an amount of cooling material, such as cooling gel, to help cool a user; or an amount of foam material, such as low-resistance polyurethane foam, to provide increased comfort to a user. In some embodiments, the internal material 560 may be removable. In some aspects, the internal material 560 may be covered by a smooth, soft, or other material that may feel comfortable against a user's skin, such as silk, cotton, or satin, as non-limiting examples.

By way of example and not limitation, the internal material 560 may comprise an amount of cooling gel within the first strap 510 and the second strap 515, wherein the cooling gel may be covered by a cotton material. The cooling gel may be removed from the cotton material, such as through at least one open or closable aperture, and placed in a refrigerator or freezer to be cooled before being reinserted into the body positioning apparatus 500 for use. In some aspects, a closable aperture used to access the internal material 560 may be at least partially sealed by means of at least one zipper, snap, button, clasp, clamp, or similar mechanism, as non-limiting examples.

Figure 6:
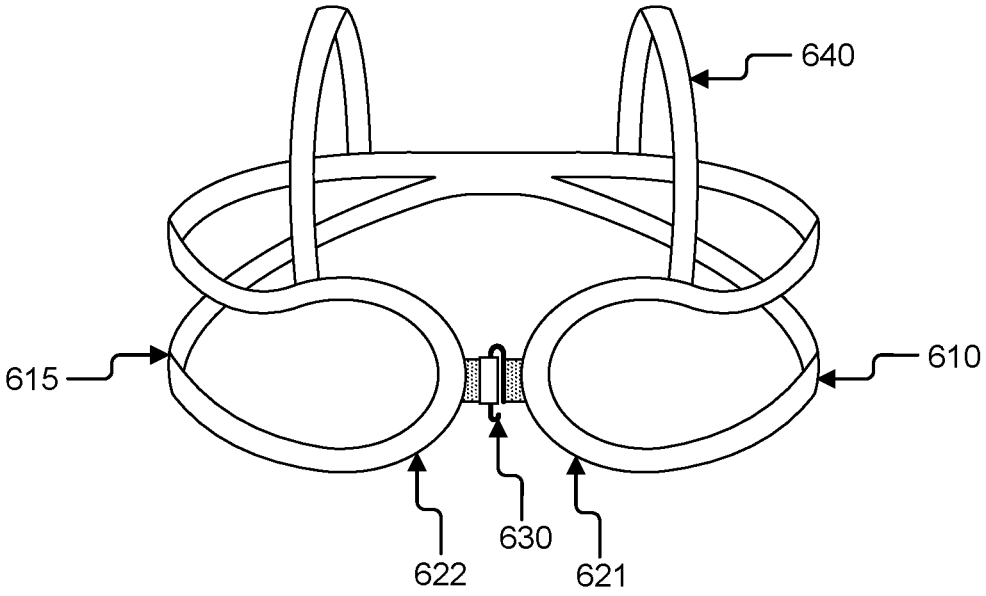
FIG. 6 illustrates an exemplary body positioning apparatus comprising an alignment portion, according to some embodiments of the present disclosure.

Referring now to FIG. 6, an exemplary body positioning apparatus 600 comprising an alignment portion 640 is illustrated. In some embodiments, the body positioning apparatus 600 may comprise a first strap 610. In some implementations, the body positioning apparatus 600 may comprise a second strap 615.

In some embodiments, the curved transition portions 621, 622 of both the first strap 610 and the second strap 615 may be securely or removably connected by at least one connecting element 630. In some aspects, at least one connecting element 630 used with the body positioning apparatus 600 may comprise at least one fastening mechanism to removably secure the transition portions 621, 622 of the first strap 610 and the second strap 615 together. By way of example and not limitation, the at least one fastening mechanism may comprise at least one of: a hook, a buckle, a clip, a clasp, a magnet, a hook and loop fastener, and a snap.

In some embodiments, the at least one fastening mechanism may comprise at least one adjustment means, such as, by way of example and not limitation, a buckle, that may allow the size or fit of the body positioning apparatus 600 to be adjustable by altering the length of an exposed or usable portion of the connecting element(s) 630 with which the fastening mechanism may be integrated. In some implementations, the anterior position of the fastening mechanism on the at least one connecting element 630 may improve the ease of access for purposes of adjusting and improving the comfort of the fit of the body positioning apparatus 600, and may also make donning and removing the body positioning apparatus 600 easier for a user.

CONCLUSION

A number of embodiments of the present disclosure have been described. While this specification contains many specific implementation details, these should not be construed as limitations on the scope of any disclosures or of what may be claimed, but rather as descriptions of features specific to particular embodiments of the present disclosure.

Certain features that are described in this specification in the context of separate embodiments can also be implemented in combination or in a single embodiment. Conversely, various features that are described in the context of a single embodiment can also be implemented in combination in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous. Nevertheless, it will be understood that various modifications may be made without departing from the spirit and scope of the claimed disclosure.

What is claimed is:

1. A body positioning apparatus, comprising:

a first strap comprising two distal ends, wherein the two distal ends of the first strap converge such that the first strap forms a first loop that comprises an upper portion, a lower portion, a transition portion, and a substantially open inner area;

a second strap comprising two distal ends, wherein the two distal ends of the second strap converge such that the second strap forms a second loop that comprises an upper portion, a lower portion, a transition portion, and a substantially open inner area;

wherein the first strap and the second strap each comprise at least one at least partially elastic material that gives the first strap and the second strap an elasticity; and at least one alignment portion, wherein the at least one alignment portion comprises a second at least one at least partially elastic material that gives the at least one alignment portion an elasticity, wherein the elasticity of the first strap and the elasticity of the second strap is greater than the elasticity of the at least one alignment portion.

2. The body positioning apparatus of claim 1, wherein the at least one alignment portion comprises two distal ends, wherein the two distal ends of the at least one alignment portion are connected to the upper portion of at least one of: the first strap and the second strap.

3. The body positioning apparatus of claim 2, wherein the at least one alignment portion is configured to at least partially extend around at least one of: at least a portion of a shoulder of a user and at least a portion of a neck of the user when the body positioning apparatus is worn by the user.

4. The body positioning apparatus of claim 3, wherein the body positioning apparatus comprises a first at least one alignment portion and a second at least one alignment portion, wherein the first at least one alignment portion is configured to extend over a first shoulder of the user and the second at least one alignment portion is configured to extend over a second shoulder of the user when the body positioning apparatus is worn by the user.

5. The body positioning apparatus of claim 1, wherein the body positioning apparatus further comprises at least one connecting element.

6. The body positioning apparatus of claim 5, wherein the at least one connecting element connects the transition portion of the first strap to the transition portion of the second strap.

7. The body positioning apparatus of claim 6, wherein the at least one connecting element comprises a third at least one at least partially elastic material that gives the at least one connecting element an elasticity.

8. The body positioning apparatus of claim 7, wherein the elasticity of the at least one connecting element is greater than the elasticity of the first strap and the elasticity of the second strap.

9. The body positioning apparatus of claim 6, wherein the at least one connecting element is removable.

10. The body positioning apparatus of claim 6, wherein the at least one connecting element comprises at least one fastening mechanism.

11. The body positioning apparatus of claim 10, wherein the at least one fastening mechanism comprises at least one of: a clasp, a hook, a magnet, a hook and loop fastener, a clip, a buckle, and a snap.

12. The body positioning apparatus of claim 1, wherein the body positioning apparatus further comprises at least one fastening mechanism configured to removably attach at least one of the two distal ends of the first strap to at least one of the two distal ends of the second strap.

13. The body positioning apparatus of claim 12, wherein the at least one fastening mechanism comprises at least one of: a clasp, a hook, a magnetic, a hook and loop fastener, a clip, a buckle, and a snap.

14. The body positioning apparatus of claim 1, wherein the substantially open inner area of the first strap is configured to removably receive at least a portion of a first breast of a user, and the substantially open inner area of the second strap is configured to removably receive at least a portion of a second breast of the user, wherein the elasticity of the first strap is configured to apply an outward lateral force to the first breast of the user and the elasticity of the second strap is configured to apply an outward lateral force to the second breast of the user when the body positioning apparatus is worn by the user.

15. The body positioning apparatus of claim 1, wherein the body positioning apparatus further comprises at least one internal material within at least one internal portion of at least one of: the first strap and the second strap.

16. The body positioning apparatus of claim 15, wherein the at least one internal material comprises at least one of:

an absorbent material, an insulating material, a cooling material, and a foam material.

17. The body positioning apparatus of claim 1, wherein the body positioning apparatus further comprises at least one intermediate material, wherein the at least one intermediate material covers the substantially open inner area of at least one of: the first strap and the second strap.

* * * * *